US007134965B1

(12) United States Patent
Deasy

(10) Patent No.: US 7,134,965 B1
(45) Date of Patent: Nov. 14, 2006

(54) PROCESS FOR PLAYING THE BILLIARD GAME OF 5-BALL

(76) Inventor: Christopher Deasy, 5234 S. Equestrian Ave., Sierra Vista, AZ (US) 85650

( * ) Notice: Subject to any disclaimer, the term of this patent is extended or adjusted under 35 U.S.C. 154(b) by 0 days.

(21) Appl. No.: 10/926,885

(22) Filed: Aug. 25, 2004

(51) Int. Cl.
*A63D 15/00* (2006.01)

(52) U.S. Cl. ..... 473/1; 473/4

(58) Field of Classification Search ..... 473/1–4, 473/14, 19, 21, 26, 40, 41
See application file for complete search history.

(56) References Cited

U.S. PATENT DOCUMENTS 4,005,861 A * 2/1977 Tomczak ..... 473/40
4,307,881 A * 12/1981 Jaworski ..... 473/40
4,452,450 A * 6/1984 Cayton ..... 473/40
4,619,455 A * 10/1986 Quraishi ..... 273/118 R
5,350,171 A * 9/1994 Wozniak ..... 473/1
6,261,187 B1 * 7/2001 Tsai ..... 473/40
6,644,662 B1 * 11/2003 Cao et al. ..... 273/123 R
6,860,816 B1 * 3/2005 Bond et al. ..... 473/2
6,986,714 B1 * 1/2006 Porper et al. ..... 473/1
2001/0044343 A1 * 11/2001 Rupert ..... 473/40
2005/0130754 A1 * 6/2005 Fliedner et al. ..... 473/40

* cited by examiner

*Primary Examiner*—Mitra Aryanpour

(57) ABSTRACT

A process for playing the billiard game of 5-Ball without any racking device, utilizing five object balls (number on ball is immaterial), and a cue ball. Opponent places the five object balls anywhere on the billiard table for the shooter. Placement of the object balls can not be closer than one ball width to another object ball. After legal placement of the five object balls, the shooter starts the game with ball-in-hand. The shooter calls each shot and continues to shoot when pocketing the called object ball. Any foul or failure to pocket an object ball in the correct pocket gives the opponent ball-in-hand. The player who pockets the last object ball left on the billiard table wins.

1 Claim, 4 Drawing Sheets

Legal Placement of Object Balls to Start the Game of 5-Ball

References:
A – Billiard Table
B – Cue Ball
C – Object Balls

Figure 1 – Legal Placement of Object Balls to Start the Game of 5-Ball
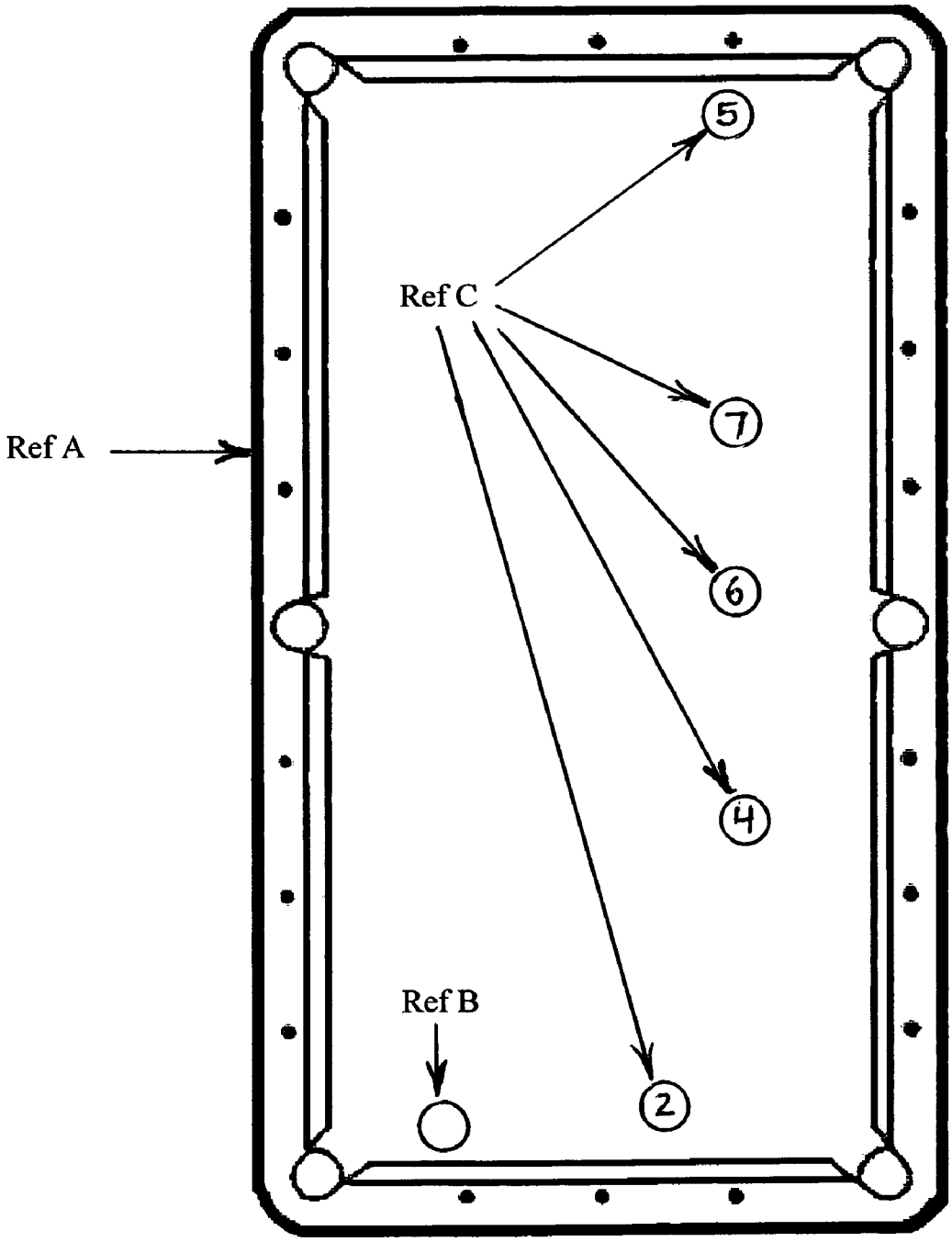
References:
A – Billiard Table
B – Cue Ball
C – Object Balls Figure 2 – Illegal Placement of Object Balls to Start the Game of 5-Ball
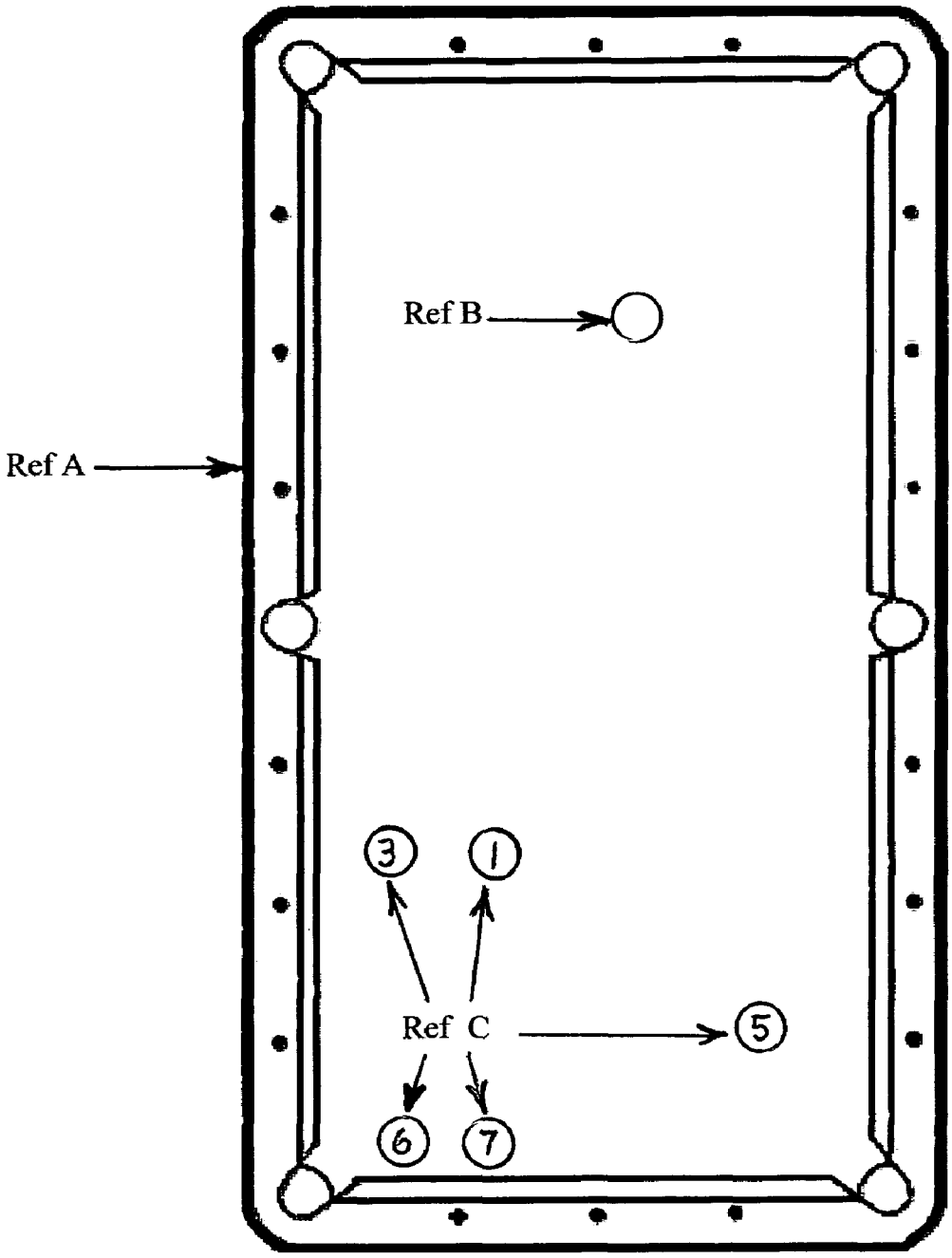
References:
A – Billiard Table
B – Cue Ball
C – Object Balls Figure 3 – Extremely Hard Placement of Object Balls to Start the Game of 5-Ball
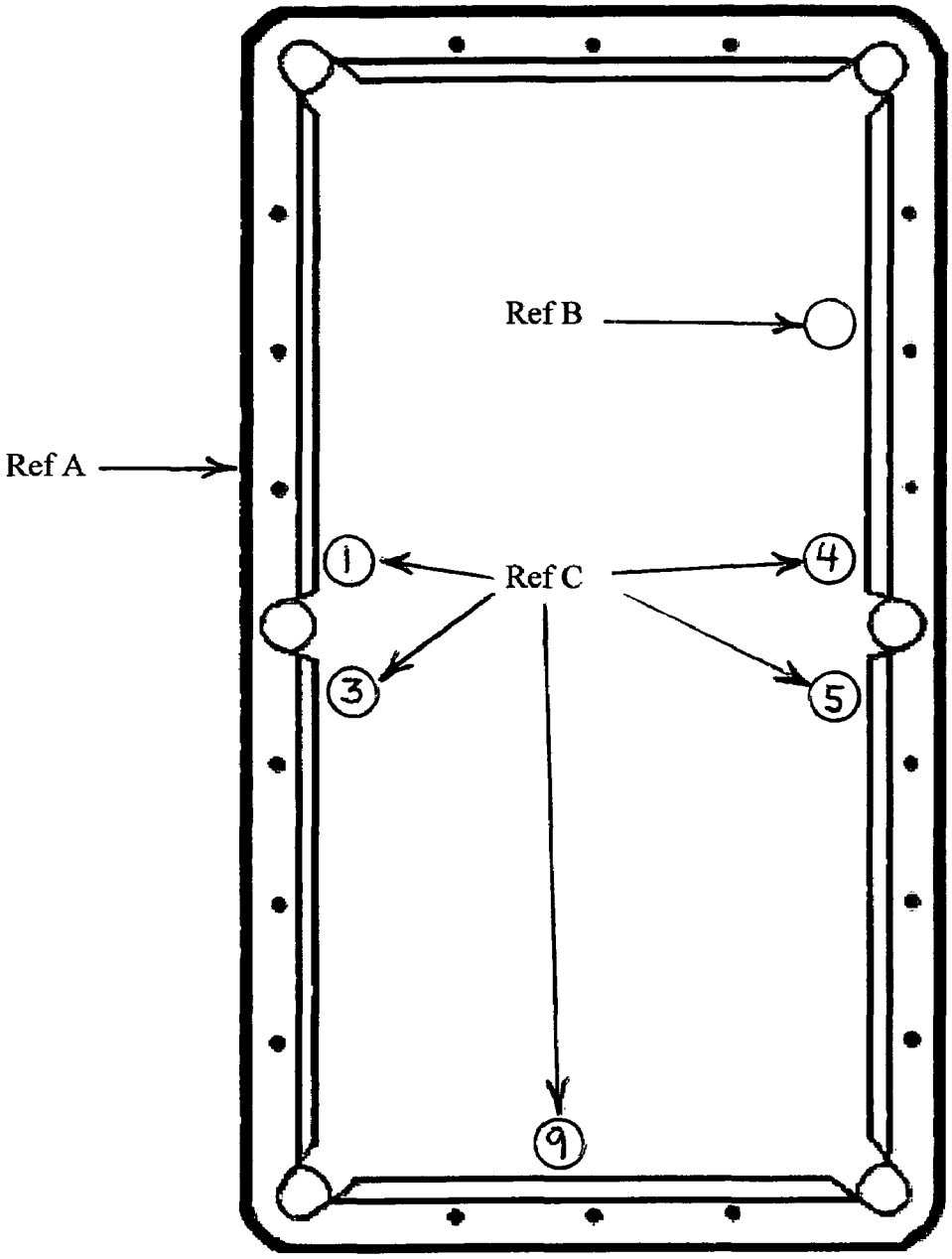
References:
A – Billiard Table
B – Cue Ball
C – Object Balls Figure 4 - Easy Placement of Object Balls to Start the Game of 5-Ball
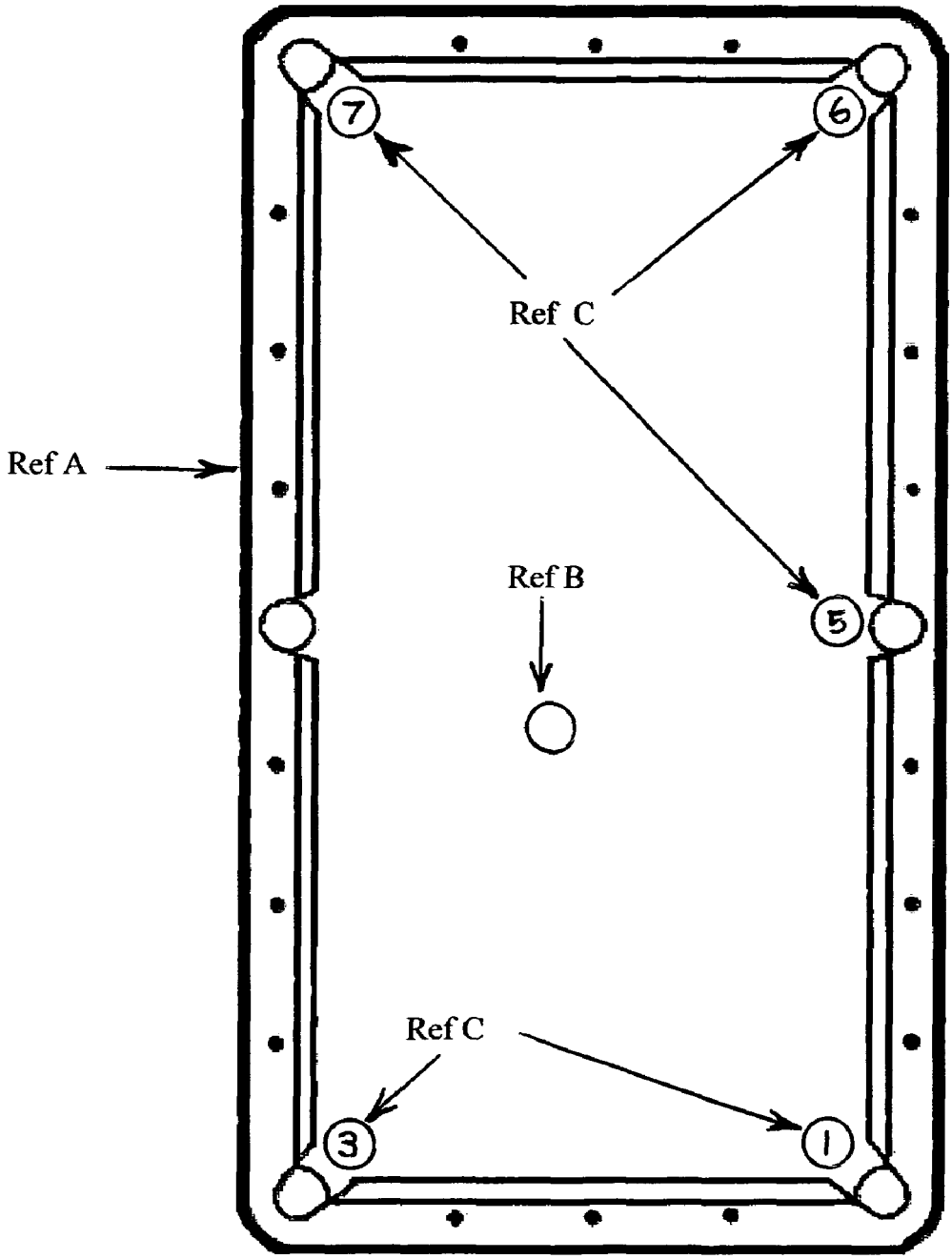
References:
A – Billiard Table
B – Cue Ball
C – Object Balls

PROCESS FOR PLAYING THE BILLIARD GAME OF 5-BALL

| Cross Reference to Related Applications | | | |
|---|---|---|---|
| 4,005,861 | February 1977 | Tomczak | 473/1. |
| 5,800,273 | September 1998 | Potocki | 473/1. |

STATEMENT REGARDING FEDERALLY SPONSORED RESEARCH OR DEVELOPMENT

Not Applicable

DESCRIPTION OF ATTACHED APPENDIX

Not Applicable

1. Background of the Invention

This invention relates to a pocket billiard game played on a conventional table with five object balls (number on ball is immaterial), cue ball, cue stick, and rules.

2. Description of the Prior Art

Pocket billiards is conventionally played on a generally rectangular table having a surface twice as long as it is wide. Six pockets are provided: one at each of the corners of the rectangle and one at each center of the two longitudinal sides or rails of the table. There are many popular games played on such a pocket billiards table which vary in the number of balls utilized. Balls, identical in diameter and small enough in diameter in order to be able to enter the pockets smoothly are utilized as targets. In general, one ball, commonly white and known as the cue ball is propelled by being struck by an instrument known as a cue stick. The usual object of a pocket billiards game is to cause the cue ball to contact one or more other balls known as the object balls and further cause one or more object balls to enter the pockets.

It will be recognized by those familiar with billiards that there are many variations of games that can be played with five balls.

There is no prior technology of the billiard game 5-Ball.

There is no deficiency in not having 5-Ball invented earlier.

BRIEF SUMMARY OF THE INVENTION

The applicant's invention relates to a billiard game that can be extremely fast, very strategic, and challenge the competitors intellect and billiard skills. The applicant's invention does not utilize any racking device and uses five object balls and one cue ball. The game starts with deciding who will shoot first. A flip of a coin is sufficient to determine the order of play. The winner of the coin flip has the choice of placing the five object balls on the billiard table or shooting first. Should the winner of the coin toss select to shoot first the opponent would shoot first for the second game and it would continue to rotate in order. Players should agree on the number of games to be played in order to determine who wins the match of 5-Ball. The inventor prefers to play shorter matches e.g.—the first player to win five games wins the match of five-ball. It is recognized that the number of games to determine the match can be higher or lower than five. The player that is not shooting first, places the five object balls anywhere on the billiard table, but not are closer than one ball length between object balls (FIG. 1). FIG. 2 shows an illegal placement of the five object balls at the start of the game (two object balls closer than one ball width). After a legal placement of the five object balls on the billiard table, the game begins. Throughout the game of five-ball, ball in hand is in effect. The game starts with the shooter having ball in hand. Should a player fail to pocket any object ball during the game, the opponent gets ball-in-hand. The player who is able to pocket the final object ball wins the game. The match continues and the person who placed the object balls on the billiard table for the last game now shoots first. The other player places the object balls on the billiard table in a legal fashion and the second game starts.

5-Ball is unique because you do not use a racking device. The object balls are hand placed and ball in hand is in effect throughout the game. The plyers can place the object balls in extremely difficult places so his opponent can not shoot all five during one turn (FIG. 3). In turn ball placement can be made extremely easy for novice shooters (FIG. 4), in hopes they miss their shot. Then the opponent would get ball-in-hand and possibly an easy win.

The placement of the object balls at the beginning of each game is critical and unique for a game with only five object balls. With an extremely hard placement the opponent might miss their shot, therefore it would be the opponents turn to shoot. And should one fail, the opponent gets ball-in-hand and a possible win. A placement that is too easy can lead to five quick shots and an easy win.

5-Ball can change quickly: a player can pocket the first four object balls and miss on the final shot. Should this happen, the opponent gets ball-in-hand and an easy win.

The player who places the object balls on the table can use any object ball, the number on the ball being immaterial. The applicant of the invention might use the eight ball and nine ball. Players tend to be programmed to shoot those balls last to win the game. But in 5-Ball, there is no sequence to pocket the object balls. Another strategy the applicant might use when playing a novice player is to bury the object balls deep inside the pocket on the table (FIG. 4). This placement usually allows a quick win for the placer of the object balls. The novice shooter will usually scratch on one of the five object balls. Then the applicant would get ball-in-hand and possibly, an easy win.

The primary object of the invention is to provide an alternative billiard game.

Another object of the invention is to provide a challenging billiard game that includes strategy on the placement of the object balls, challenges a player's billiard skills, build confidence to make five shots in a row, and create readiness for ball in hand.

Another object of the invention is to create a billiard game where the opponent places the five balls anywhere on the table at least one ball length apart from any other ball.

A further object of the invention is to create a challenging billiard game that does not utilize any racking device and is fast paced.

Yet another object of the invention is to create a billiard game that can improve one's billiard shooting skills. Playing alone allows a player to place the object balls in extremely difficult places or places in which the shooter does not shoot well. For example, a player might not be comfortable with rail shots, so one would place all five balls on different rails around the billiard table.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a process for playing the billiard game of 5-Ball comprising these steps: no one has ever invented a 5-Ball billiard game, the game includes strategy on the placement of the object balls, the game does not use any racking device, and the person placing the object balls to start the game is not guaranteed a shot.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

FIG. 1 is a plan view of the invention and legal placement of the object balls to start the game. Although FIG. 1 shows the object balls running straight down the middle of the billiard table, they can be placed anywhere. The number of legal placements are numerous.

FIG. 2 is a plan view of the invention and illegal placement of the object balls to start the game. Two sets of object balls are closer than one ball width, therefore making this an illegal placement. The game can not start until the placement is legal.

FIG. 3 is a plan view of the invention and an extremely difficult placement of five object balls to start the game, also a legal placement. What makes this placement difficult is the object balls placement just a half inch in on the rail nearest the center pockets. This placement sets up a scratch on the four object balls placed near the center rail pockets.

FIG. 4 is a plan view of the invention and an easy placement of five object balls to start the game, also a legal placement. An easy placement makes your opponent have to pocket all the object balls in order to avoid ball-in-hand.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

5-BALL (DESCRIPTION OF GAME)

(World Standardized Rules)

Except when clearly contradicted by these additional rules.

the General Rules of Pocket Billiards apply.

OBJECT OF THE GAME: 5-Ball is played with five object balls (numbers immaterial) and a cue ball. The opponent places five balls anywhere on the billiard table, but at least one ball length apart. The game starts with ball in hand. If a player pockets any ball on a legal shot, he/she remains at the table for another shot, and continues until he/she misses, fouls, or wins the game by pocketing the final ball on the table. After a miss, the incoming player gets ball in hand and continues the same procedures. Players are required to call all shots. A match ends when one of the players has won the required number of games.

LEGAL PLACING OF BALLS AT THE BEGINNING OF THE GAME: Five balls are placed anywhere on the billiard table, the number on the object balls being immaterial. Balls can not be closer than one ball length to another ball.

START OF THE GAME: The opponent places the balls in any position he/she wishes. The other player starts with ball in hand. Every game will rotate: next game, the opponent shoots first and his/her opponent places the balls on the table and this continues throughout the match.

FOULS: When a player commits a foul, he must relinquish his/her turn at the table and no balls pocketed on the foul shot are respotted. The incoming player is awarded ball-in-hand.

IN HAND: If no object ball is pocketed, the incoming player is awarded ball-in-hand. That person is allowed to place the cue ball anywhere on the billiard table.

OBJECT BALLS JUMPED OFF THE TABLE: An unpocketed ball is considered to be driven off the table if it comes to rest in a place other than on the bed of the table. It is a foul to drive the object ball off the table. The jumped object ball(s) is not respotted and play continues with the incoming player being awarded ball-in-hand.

END OF GAME: The game ends when the final object ball is pocketed. Should a player pocket the final object ball in a pocket that was not called, the player losses the game.

While the invention has been described in connection with a preferred embodiment, it is not intended to limit the scope of the invention to the particular form set forth, but on the contrary, it is intended to cover such alternatives, modifications, and equivalents, as may be included within the spirit and scope of the invention as defined by the appended claims.

What is claimed is:

1. A method of playing a game using only 5-object balls on a billiard table, the table having a playing surface, a plurality of end rails, side rails and a plurality of pockets, the game played by at least a first and second player comprising the steps of:

providing five object balls; wherein the object balls may be numbered or unnumbered;

providing a cue ball;

providing a cue stick;

providing a set of game rules;

determining the number of games to be played in order to determine the winner of the game;

the at least first and second player predetermining player turn;

the first player electing to either shoot first or to place the five object balls anywhere on the playing surface without the use of a racking device;

placing the five object balls anywhere on the playing surface at least one ball length apart from any other object ball;

beginning the game with the first player or shooter having ball-in-hand, placing the cue ball anywhere on the playing surface;

the first player or shooter calling out each shot prior to pocketing each object ball;

striking the cue ball with the cue stick and moving the cue ball towards a preselected object ball;

when the first player or shooter is unable to pocket the preselected object ball, the second or incoming player is awarded ball-in-hand; the second player or incoming player being allowed to place the cue ball anywhere on the playing surface;

when the player or shooter commits a foul, the second or incoming player is awarded ball-in-hand, the incoming player is allowed to place the cue ball anywhere on the playing surface;

the first player or shooter looses the game, if the first player or shooter pockets the last remaining object ball in a pocket other than the called-out pocket;

the second player repeating the above steps; alternating game play between the first and second players; and the first player to win the predetermined number of games first, is declared a winner.

* * * * *